United States Patent [19]

Bonsall

[11] 4,087,678

[45] May 2, 1978

[54] LIBRARY LATE-BOOK FINE COMPUTER

[75] Inventor: George Bonsall, Williamsport, Pa.

[73] Assignee: Brodart, Inc., Williamsport, Pa.

[21] Appl. No.: 689,005

[22] Filed: May 24, 1976

[51] Int. Cl.[2] ..... G09D 1/00

[52] U.S. Cl. ..... 235/86; 235/89 R

[58] Field of Search ..... 235/70 R, 70 A, 70 C, 235/85 R, 86, 89 R, 71 R, 71 A

[56] References Cited

U.S. PATENT DOCUMENTS

| | | | |
|---|---|---|---|
| 1,149,516 | 8/1915 | Hirshberg | 235/86 X |
| 3,815,269 | 6/1974 | Roselli | 235/89 R X |

*Primary Examiner*—Lawrence R. Franklin

*Attorney, Agent, or Firm*—Alan H. Levine

[57] ABSTRACT

A computer including a base and a member superposed over the base and movable with respect to it. The base may be a card and the member may be a continuous flexible band surrounding the card. The band is slidable along the length of the card and also movable in the direction of its continuity. A series of dates, each including a month and day, is carried by one of the base and member, and a series of numbers is carried by the other. The dates are arranged in day-by-day sequence, and the numbers are in sequence with each successive number being larger than the one immediately previous to it by the amount of one day's fine. When the zero position of the sequence of numbers is moved opposite to the current date, the number adjacent the date on which a book was due will be the amount of the late fine.

1 Claim, 4 Drawing Figures

LIBRARY LATE-BOOK FINE COMPUTER

This invention relates to lending library transactions, and more particularly to the act of determining the correct fine when a book is returned to the library after the date upon which it was due.

When a book is returned late to a lending library, conventionally the librarian counts the number of days between the date the book was due and the current date, and then multiplies by the daily rate of fine, e.g., five cents per day, to determine the amount of fine due. This is a time consuming procedure, since it involves counting days on a calendar and then doing the arithmetic computation described above. Furthermore, since librarians are often busy, it is very easy to make errors in the fine calculation, even though the procedure is a simple one. In addition, the longer that a book is overdue, the more time-consuming the procedure since more days must be counted on the calendar.

It is an object of the present invention to provide a computer by means of which a late-book fine can be determined very rapidly, i.e., within a few seconds, regardless of how long the book is overdue.

It is another object of the invention to provide such a computer which greatly minimizes or eliminates the chance of error in calculating the amount of a fine.

It is a further object of the invention to provide such a computer which is a simple, non-electrical device, inexpensive to manufacture and easy to use.

It is an additional object of the invention to provide such a computer involving a day-by-day sequence of dates, carried by one element, and a series of numbers which increase in sequence by the amount of one day's fine, carried by another element, the elements being movable with respect to each other so that a zero position in the sequence of numbers can be brought adjacent to the current date, whereby the number adjacent to the due date of the book indicates the amount of the fine.

Additional objects and features of the invention will be apparent from the following description in which reference is made to the accompanying drawings.

Figure 1:
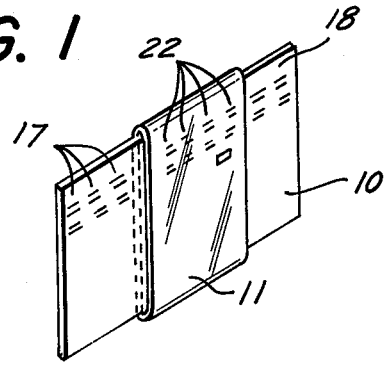
FIG. 1 is a perspective view of a library late-book fine computer according to the present invention.
Figure 4:
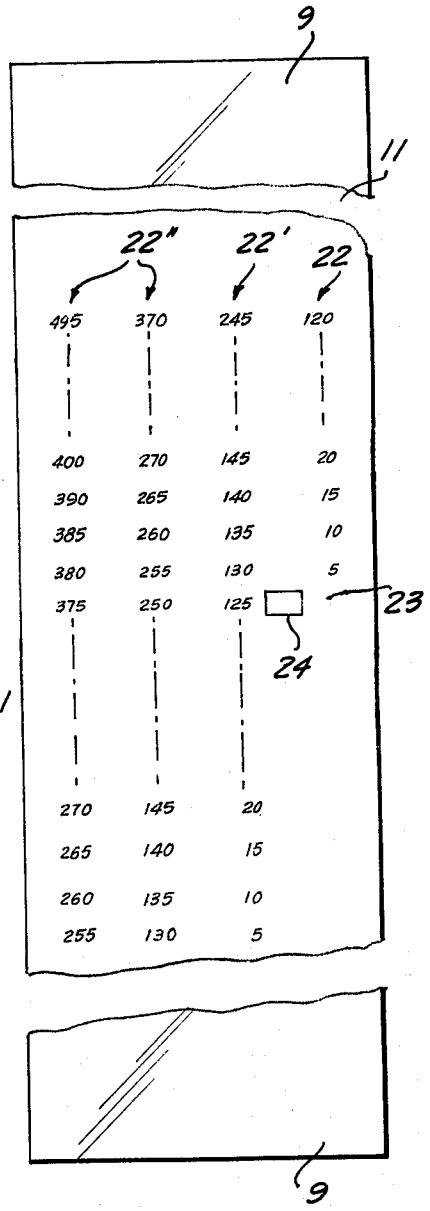
FIG. 4 is a face view of the band member in opened and flattened condition.

The library late-book fine computer chosen to illustrate the present invention includes two parts, namely, a base 10 and a member 11 superposed over the base and movable in a limited manner with respect to the base. In the example shown, the base 10 is a flat rectangular plate or card which may be formed of paperboard or plastic thick enough to make the base relatively stiff. Member 11 is shown as a continuous flexible band which is preferably formed of a thin transparent plastic. Member 11 may be an initially flat sheet (as shown in FIG. 4) bent upon itself to bring its ends 9 together in butted or overlapped condition, and the ends joined to each other in any suitable manner.

Member 11 surrounds base 10 such that the base fits rather snugly within member 11. However, member 11 is slidable with respect to base 10 in the direction of the double-headed arrow 12, the parallel edges 13 of the base serving as guide edges for guiding this relative movement of the base and member. Member 11 is also movable with respect to base 10 in the direction of continuity of the member, as indicated by the double headed arrow 14.

Figure 2:
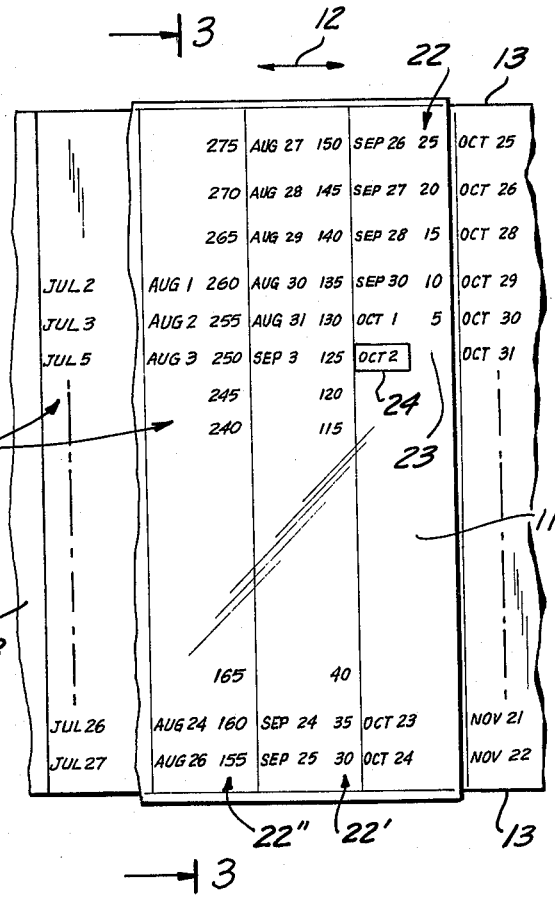
FIG. 2 is a fragmentary face view of the computer.
Figure 3:
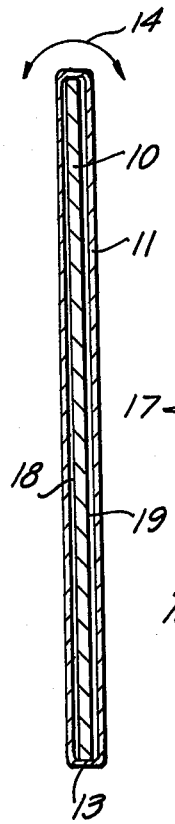
FIG. 3 is a cross-sectional view taken along line 3—3 of FIG. 2.

Base 10 carries, on at least one of its faces, a plurality of columns 17, each column comprising a series of dates. Each date includes a month and a day, e.g., Apr. 14, and the dates are arranged in day-by-day sequence in each column. Furthermore, the sequence continues from column-to-column, so that the date at the top of each column is the day following the date at the bottom of the column immediately to the left of that column. Each column 17 includes the same number of dates, say, 25, and all the columns are parallel to each other and perpendicular to guide edges 13 of base 10. If desired, the computer may be made specifically for use during a particular year, or other period of time, and in such case dates corresponding to Sundays and holidays, for which no fines are charged, may be omitted. Thus, in FIG. 2 it will be noted that July 4 has been omitted in the left hand column, and July 28 and Aug. 25, representing Sundays, have been omitted in the next-to-left hand column. Columns 17 may be printed or applied to base 10 in any other suitable manner.

In order to reduce the size of base 10, preferably columns of dates 17 are carried on both faces 18 and 19 of the base. There may be ten columns 17 on each face, so that each face bears, say, 250 dates. The left hand column on each face 18, 19 preferably begin with dates which are six months apart, e.g., the left hand column on face 18 may begin with Apr. 1, and the left hand column on face 19 may begin with Oct. 1. It will be appreciated that there is a repetition of some dates on both faces, the reason for which will be seen below.

Band member 11 carries a plurality of columns 22, each including a series of numbers. The numbers are arranged in an ascending sequence from the bottom to the top of each column, each number being larger than the one immediately below it by the amount of one day's fine. Thus, if the late fine is five cents per day, the numbers increase in sequence by five, e.g., 5, 10, 15, 20. The right-hand-most column 22 begins with a zero position 23, immediately to the left of which is a rectangular box 24.

Columns 22 are parallel to each other and to the columns of dates 17. Furthermore, columns 22 are spaced apart sufficiently so that a column 17 of dates can be viewed between each two successive columns 22 of numbers. Likewise, columns 17 of dates are spaced apart sufficiently so that a column of numbers 22 fits between any two successive columns 17. Consequently, member 11 may be moved, in the direction of arrow 12, to positions in which columns 17 and 22 appear in alternate vertical rows, i.e., rows perpendicular to guide edges 13. The vertical spacing between successive dates in columns 17 and between successive numbers in columns 22 are the same, so that successive numbers in the columns 22 can be brought into horizontal alignment simultaneously with successive dates in the columns 17.

The right-hand-most column 22 (FIG. 2) contains at least as many numbers (including zero position 23), say 25, as there are dates in each column 17. Each column 22′, 22″ to the left of the right-hand-most column contains at least twice the number of numbers as there are dates in each column 17, minus one. Thus, in the present example, each such column contains at least 49 [(2 × 25) − 1] numbers. Furthermore, the second from the right column 22′ begins with the number equal to the lowest amount of fine, in this case 5 (see FIG. 4). In addition, the lowest number in the column 22' is located such that when member 11 is adjusted in the direction of arrow 14 to bring box 24 over the uppermost date in one column 17, the lowest number in column 22' is horizontally aligned with the lowest date in the column 17 immediately to the left of said one column. Also, each number in each column 22, 22', 22'' is horizontally aligned with numbers in other columns, and the difference between horizontally aligned numbers in two adjacent columns equals the number of dates in each column 17 multiplied by the amount of one day's fine. In the present example, this difference equals 125 (25 × 5).

In use, when a book is returned to a library after the date it was due, member 11 is moved with respect to base 10, in the directions of arrows 12 and 14, to bring box 24 over the current date, i.e., the date the book is being returned. The librarian then simply looks at the date the book was due, and the amount of the fine is the number to the right of that date. For example, in FIG. 2 the book is being returned on Oct. 2. If the book was due on Oct. 1, the amount of the fine is 5¢. If the book was due on Aug. 30, the amount of the fine is $1.35. If the book is being returned on Sept. 26, and it was due Sept. 25, member 11 is moved in the direction of arrow 14 to raise box 24, in FIG. 2, until it is over the date "Sep 26." The lowermost number "5" in column 22' will be to the right of the lowermost date "Sep 25" in the column 17 immediately to the left of the column headed by the date "Sep 26."

As pointed out above, more than six months of dates appear on each face of base 10. This is important so that on at least one face of base 10, there will be columns of dates 17 to the left of any selected date. In other words, if Apr. 1 were to appear only once, and that once it was the first date in the left-hand-most column 17, the computer could not indicate the fine for late books returned on Apr. 1. The reason is that if box 24 were placed over Apr. 1, all the numbers in right-hand-most column 22 would be above Apr. 1, and all the other columns of numbers would be to the left of the edge of base 10. However, with the left-hand-most column 17 on the reverse side of base 10 beginning with the date Oct. 1, the date Apr. 1 appears in about the seventh of the ten columns 17 on the reverse side.

The invention has been shown and described in preferred form only, and by way of example, and many variations may be made in the invention which will still be comprised within its spirit. For example, instead of member 11 being transparent, it could be formed of an opaque material, such as paper, and provided with a series of cut outs so that the dates in columns 17 can be viewed through the member. It is understood, therefore, that the invention is not limited to any specific form or embodiment except insofar as such limitations are included in the appended claims.

What is claimed is:

1. A library late-book fine computer comprising:

(a) a relatively stiff rectangular card having two parallel guide edges, (b) a series of dates uniformly spaced on at least one face of said card a predetermined distance from each other, each of said dates including a month and day, said dates being arranged in day-by-day sequence increasing in a first direction in each of a plurality of parallel columns which extend perpendicular to said guide edges, each column of dates including the same number of dates, (c) a continuous flexible band extending around the guide edges of said card, said base being viewable through said band, (d) a series of numbers, indicating amounts of fines, uniformly spaced on said band the same predetermined distance as said dates, the numbers being in sequence and increasing in a direction opposite to said first direction in each of a plurality of columns, said columns of numbers being parallel to each other and to said columns of dates, each successive number in each column of numbers being larger than its immediately previous number by the amount of one day's fine, one of said columns of numbers beginning with a zero position, said one column having a number of numbers, including the zero position, at least equal to the dates in each date column, and the remainder of the columns of numbers having a number of numbers at least equal to twice the number of dates in each date column minus one, each number in each number column being aligned in a direction parallel to said guide edges with numbers in the other number columns, the difference between each number and an aligned number in an adjacent column being equal to the number of dates in each date column multiplied by one day's fine, and (e) said band being slidable along the guide edges of said card, and said band being movable around said card in the direction of continuity of said band.

* * * * *